US010088234B2

(12) United States Patent
Tian

(10) Patent No.: US 10,088,234 B2
(45) Date of Patent: Oct. 2, 2018

(54) AUTOMATIC VACUUM PREHEATING FURNACE

(71) Applicant: SHENZHEN TIME HIGH-TECH EQUIPMENT CO., LTD, Shenzhen (CN)

(72) Inventor: Hanrong Tian, Shenzhen (CN)

(73) Assignee: SHENZHEN TIME HIGH-TECH EQUIPMENT CO., LTD, Shenzhen (CN)

( * ) Notice: Subject to any disclaimer, the term of this patent is extended or adjusted under 35 U.S.C. 154(b) by 291 days.

(21) Appl. No.: 15/026,983

(22) PCT Filed: Jan. 27, 2015

(86) PCT No.: PCT/CN2015/071615
§ 371 (c)(1),
(2) Date: Apr. 3, 2016

(87) PCT Pub. No.: WO2016/045287
PCT Pub. Date: Mar. 31, 2016

(65) Prior Publication Data

US 2016/0258683 A1 Sep. 8, 2016

(30) Foreign Application Priority Data

Sep. 25, 2014 (CN) ..... 2014 1 0494556

(51) Int. Cl.
*F27B 9/04* (2006.01)
*F26B 9/06* (2006.01)

(52) U.S. Cl.
CPC ..... *F27B 9/042* (2013.01); *F26B 9/06* (2013.01); *F27B 9/04* (2013.01)

(58) Field of Classification Search
CPC .... F27B 9/04; F27B 9/042; F27B 9/10; F27B 9/12; F27B 9/122; F27D 13/00
See application file for complete search history.

(56) References Cited

U.S. PATENT DOCUMENTS 3,787,171 A * 1/1974 Cromp ..... F26B 21/14 432/59
5,261,976 A * 11/1993 Schultz ..... C21D 1/76 148/508

(Continued)

FOREIGN PATENT DOCUMENTS

| | | |
|---|---|---|
| CN | 202158733 U | 3/2012 |
| CN | 103836886 A | 6/2014 |
| CN | 203704556 U | 7/2014 |

OTHER PUBLICATIONS

International Publication for PCT/CN2015/071615.
International Search Report for PCT/CN2015/071615.

*Primary Examiner* — Nathaniel Herzfeld

(57) ABSTRACT

An automatic vacuum preheating furnace comprises a furnace box, a vacuum extraction device used to evacuate the furnace box, a transporting device located inside the furnace box and used to transport materials, two opposite end of the furnace box have an opening respectively, an automatic sealing door is located on the opening, the automatic vacuum preheating furnace further includes preheating devices, each preheating devices includes a blasting device which is located under the furnace box and connected with the furnace box, and a wind returning device which is located upon the furnace box and connected with the furnace box, each blasting device includes a heating unit and a wind adjusting unit. Each wind adjusting unit includes wind boards, the wind boards are movably connected with two opposite sidewalls of the furnace box through hinges, the wind boards are multiple, and axes of the hinges of the wind boards are parallel to each other, and located on a same plane, the plane is parallel to a bottom of the furnace box. The structure of the automatic vacuum preheating furnace can vacuum preheat the materials the materials efficiently before vacuum drying.

10 Claims, 5 Drawing Sheets

(56) References Cited

U.S. PATENT DOCUMENTS

| | | | | |
|---|---|---|---|---|
| 5,377,425 | A * | 1/1995 | Kawakami | F26B 5/04 34/408 |
| 5,755,039 | A * | 5/1998 | Mae | F26B 9/066 34/197 |
| 6,116,894 | A * | 9/2000 | Kolln | F27B 9/12 432/152 |
| 6,151,796 | A * | 11/2000 | Karamatsu | F26B 5/04 34/403 |
| 2002/0153073 | A1* | 10/2002 | Hattori | C21D 1/74 148/712 |
| 2005/0072123 | A1* | 4/2005 | Gambetti | B65B 11/10 53/465 |
| 2010/0068669 | A1* | 3/2010 | Ishimoto | C21D 9/0056 432/77 |
| 2014/0127072 | A1 | 5/2014 | Chen et al. | |
| 2016/0258681 | A1* | 9/2016 | Tian | H01M 10/04 |

* cited by examiner

AUTOMATIC VACUUM PREHEATING FURNACE

TECHNICAL FIELD

The present invention relates to an automatic vacuum preheating furnace, especially relates to an automatic vacuum preheating furnace which can vacuum preheat materials effectively before vacuum drying the materials.

BACKGROUND ART

A vacuum drying process is an important producing process during the electronic components manufacturing processing. The vacuum drying process can reduce water contained in the electronic components, such that the electronic components can meet the using requirement. The vacuum drying process is mainly applied to the manufacturing processes of the electronic components, especially applied to the manufacturing processes of the supercapacitor or the manufacturing processes of the lithium battery. The traditional vacuum drying device mainly includes a single vacuum drying oven, and electronic components needed to be dried are transported to the vacuum drying device through a material car, the traditional vacuum drying device is poor in processing efficiency, and cannot control the dry humidity and the temperature maintain highly uniform in a vacuum condition. A plurality of vacuum drying devices having accesses corresponding to each other can form a vacuum drying system which can continuously process, the vacuum drying devices can be set different vacuum degrees, drying temperatures, and drying times to overcome the above defects existed in the single vacuum drying device. However, when the materials are directly transported into the vacuum drying system, the materials cannot be dried efficiently, so an automatic vacuum preheating furnace can be matched and worked with the vacuum drying system to dry the materials efficiently. Now the automatic vacuum preheating furnace which can preheat the materials efficiently is in need.

SUMMARY OF INVENTION

The technical problem to be solved by the present invention is to provide an automatic vacuum preheating furnace which can vacuum preheat materials efficiently.

In order to solve the above problem, the present invention provides an automatic vacuum preheating furnace, which includes a furnace box, a vacuum extraction device used to evacuate the furnace box, a transporting device located inside the furnace box and used to transport materials, two opposite ends of the furnace box have an opening respectively, an automatic sealing door is located on the opening, the key is that the automatic vacuum preheating furnace further includes preheating devices, each preheating device includes a blasting device which is located under the furnace box and connected with the furnace box, and a wind returning device which is located upon the furnace box and connected with the furnace box, each blasting device includes a heating unit and a wind adjusting unit.

As a first improvement of the invention, each blasting device is connected with the furnace box through a wind inlet, a portion of a bottom of the furnace box corresponding to the wind inlet has a plurality of through openings.

As a second improvement of the invention, an exit of the wind returning device is connected with an entrance of the blasting device.

As a third improvement of the invention, the automatic vacuum preheating furnace has multiple sets of preheating devices, and the preheating devices are located along a transporting direction of the transporting device.

As a forth improvement of the invention, the transporting device includes a plurality of first gears located in the furnace box, the first gears are driven by a motor.

As a further improvement of the invention, the first gears are coaxial with first chain wheels and fixed with the first chain wheels, the transporting device further includes a plurality of second gears located in the furnace box, the second gears are coaxial with second chain wheels and fixed with the second chain wheels, the second chain wheels are driven by the first chain wheels through a chain.

As a fifth improvement of the invention, each wind adjusting unit includes wind boards, the wind boards are movably connected with two opposite sidewalls of the furnace box through hinges, the wind boards are multiple, and axes of the hinges of the wind boards are parallel to each other, and located on a same plane, the plane is parallel to the bottom of the furnace box.

As a further improvement of the invention, each heating unit includes electric heating pipes located on/below the wind boards, the electric heating pipes are multiple, and the electric heating pipes are all parallel to the bottom of the furnace box. The automatic vacuum preheating furnace further includes a plurality of wind guide separators located below the wind boards, the wind boards are located above portions between two adjacent wind guide separators.

As a further improvement of the invention, each electric heating pipe has a bottom layer and a top layer, the bottom layer and the top layer are both parallel to the bottom of the furnace box and located at the bottom of the furnace box.

The Advantage of the Present Invention:

An automatic vacuum preheating furnace includes a furnace box, a vacuum extraction device used to evacuate the furnace box, a transporting device located inside the furnace box and used to transport materials, two opposite end of the furnace box have an opening respectively, an automatic sealing door is located on the opening, the automatic vacuum preheating furnace further includes preheating devices, each preheating device includes a blasting device which is located under the furnace box and connected with the furnace box, and a wind returning device which is located upon the furnace box and connected with the furnace box, each blasting device includes a heating unit and a wind adjusting unit. After the materials are transported into the furnace box, the openings of the furnace box are both sealed by the automatic sealing door of the automatic vacuum preheating furnace or another sealing door of outside device, the vacuum extraction device evacuates the furnace box to achieve a certain vacuum degree, the blasting device can inlet wind into the furnace box, the wind can be heated by the heating unit when passing through the heating unit, the heated wind can be adjusted by the wind adjusting unit to enter into the furnace box and preheat the materials, the wind returning device can take away the wind contained in the furnace box, such that the heated wind can preheat the materials effectively. After the materials are preheated, the automatic sealing door is opened, the transporting device can transport the materials to the automatic vacuum preheating furnace to be vacuum dried, such that automatic vacuum preheating furnace can be matched with the automatic vacuum drying device effectively, such that the materials can be vacuum dried effectively. Each wind adjusting unit includes wind boards, the wind boards are movably connected with two opposite sidewalls of the furnace box through hinges, the wind boards are multiple, and axes of the hinges of the wind boards are parallel to each other, and located on the same plane, the plane is parallel to the bottom of the furnace box, the hinges of the wind boards can be rotated to adjust an angle between the wind boards and the bottom of the furnace box, such that the heated wind can be blown on the materials at the best angle to improve the preheating efficiency. Each heating unit includes electric heating pipes located on/below the wind board, the electric heating pipes are multiple, and the electric heating pipes are all parallel to the bottom of the furnace box, such that the inlet wind can be heated rapidly through the electric heating pipes, the heated wind can be adjusted by the wind adjusting unit to be blown on the materials at the best angle, such that the materials can be heated efficiently, the electric heating pipes can ensure the inlet wind to be heated to a needed temperature rapidly. Each electric heating pipe has a bottom layer and a top layer, the bottom layer and the top layer are both parallel to the bottom of the furnace box and located at the bottom of the furnace box. Two layers of electric heating pipes can heat the wind much more efficiently, such that the heating efficient can be improved. The blasting device is connected with the furnace box through the wind inlets, the portion of the bottom of the furnace box corresponding to the wind inlet has a plurality of through openings, the heated wind can pass through the through openings to be blown into the furnace box through the bottom of the furnace box much uniformly, such that it can ensure that the materials would not appear local over preheating or local lacking of preheating, such that the materials can be preheated efficiently. The exit of the wind returning device is connected with the entrance of the blasting device, such that wind passing through the wind returning device can be blown into the furnace box again through the blasting device, as the wind passing the wind returning device has a certain temperature, such that the wind passing the wind returning device and being blown into the furnace box again can also be used to preheat the materials and it saves much energy. The automatic vacuum preheating furnace has multiple sets of preheating devices, and the preheating devices are located along the transporting direction of the transporting device, multiple sets of preheating devices can ensure that the automatic vacuum preheating furnace can preheat much more materials at once, to improve the preheating efficiently. The automatic vacuum preheating furnace further includes a plurality of wind guide separators located below the wind boards, the wind boards are located above portions between two adjacent wind guide separators, the wind guide separators can ensure that the wind can be guided to the portions of the electric heating pipes to heat the wind efficiently, at the same time, the wind guide separators can also guide the wind to move to the position of the wind adjusting unit, and ensure that the wind can be guided to the best position to heat the wind efficiently. The transporting device includes first gears located in the furnace box, the first gears are driven by the motor, the first gears can ensure that the material car having rack located at the bottom of the material car can be driven stably, such that the materials can be transported to the automatic vacuum preheating furnace from the previous process, and also ensure that the preheated materials can be transported into the vacuum drying oven rapidly to improve the vacuum preheating efficiently. The first gears are coaxial with the first chain wheels and fixed with the first chain wheels, the transporting device further includes the second gears located in the furnace box, the second gears are coaxial with second chain wheels and fixed with the second chain wheels, the second chain wheels are driven by the first chain wheels through the chain, such that material cars having different sizes and different lengths can enter into the automatic vacuum preheating furnace from the previous process smoothly, and also can enter into the automatic vacuum drying device from the automatic vacuum preheating furnace.

DESCRIPTION OF EMBODIMENTS

Figure 1:
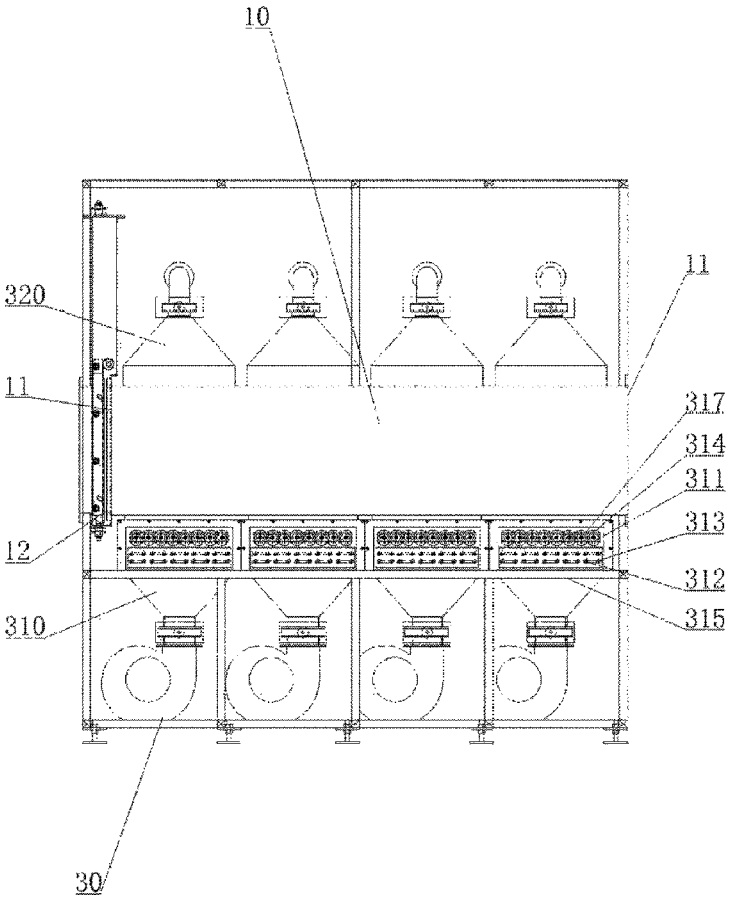
FIG. 1 is an isometric view of an automatic vacuum preheating furnace of the present invention.

Referring to FIG. 1, an automatic vacuum preheating furnace includes a furnace box 10, a vacuum extraction device used to evacuate the furnace box 10, a transporting device 20 located inside the furnace box 10 and used to transport materials, and preheating devices 30, two opposite ends of the furnace box 10 have one opening 11 respectively. The vacuum extraction device can only be a vacuum pump, or can be composed of vacuum pump and filter, or vacuum pump and roots pump, and the filter can be dry ice filter or oil filter, in one exemplary embodiment, the vacuum extraction device is composed of vacuum pump and oil filter. The transporting device 20 can be a conveyer belt, a conveyer roller, or a material car, the material car is driven by gears located inside the furnace box 10, a bottom of the material car has rack. In an exemplary embodiment, the transporting device 20 can be the material car having rack located at the bottom of the material car, the material car is driven by the gears located inside the furnace box 10. An automatic sealing door 12 is located on one opening 11, each preheating device 30 includes a blasting device 310 which is located under the furnace box 10 and connected with the furnace box 10, and a wind returning device 320 which is located upon the furnace box 10 and connected with the furnace box 10, the blasting device 310 includes a heating unit 311 and a wind adjusting unit 313. An exit of the wind returning device 320 is connected with an entrance of the blasting device 310. The automatic vacuum preheating furnace has multiple sets of preheating devices 30, and the preheating devices 30 are located along a transporting direction of the transporting device 20.

Figure 3:
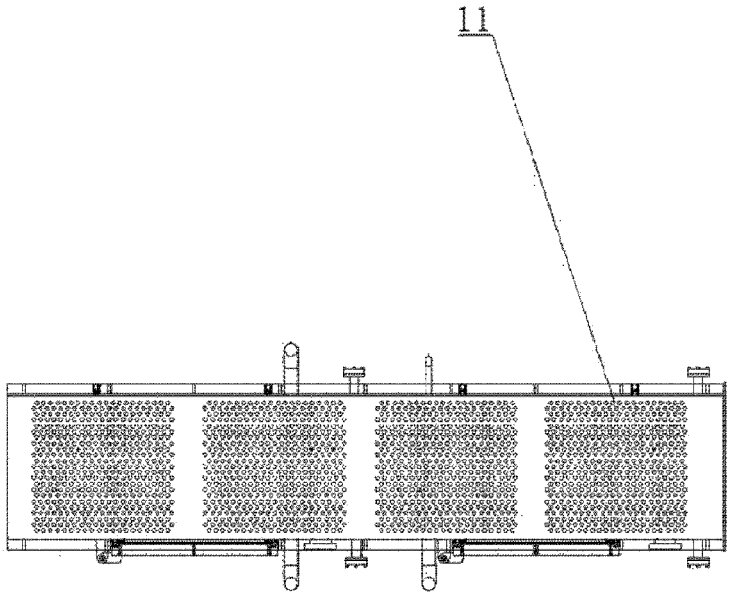
FIG. 3 is an isometric view of a bottom of a furnace box of the present invention.

Referring to FIGS. 1 and 3, the blasting device 310 can be connected with the furnace box 10 through wind inlets 315, a portion of the bottom of the furnace box 10 corresponding to the wind inlets 315 has a plurality of through openings 11.

Figure 4:
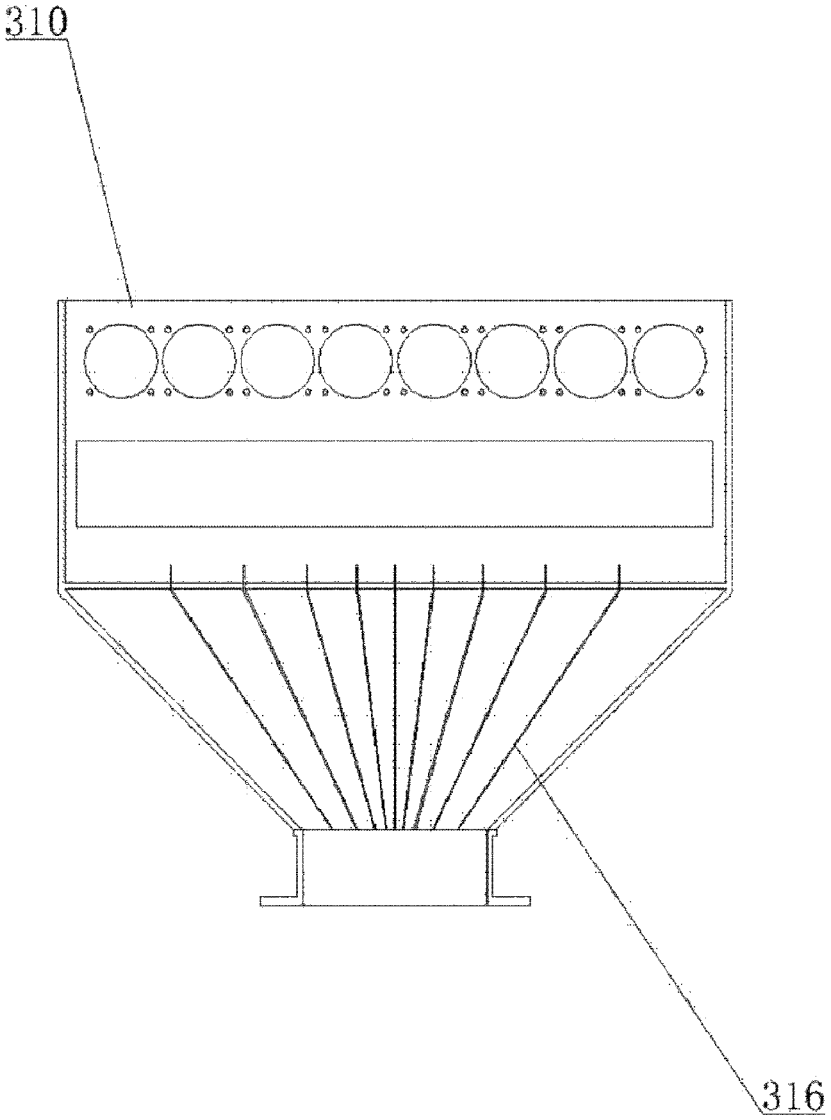
FIG. 4 is an assembled isometric view of a wind guide separator of the present invention.

Referring to FIGS. 1 and 4, a bottom of each wind board 314 has a plurality of wind guide separators 316, the wind boards 314 are located above portions between two adjacent wind guide separators 316 respectively.

Figure 5:
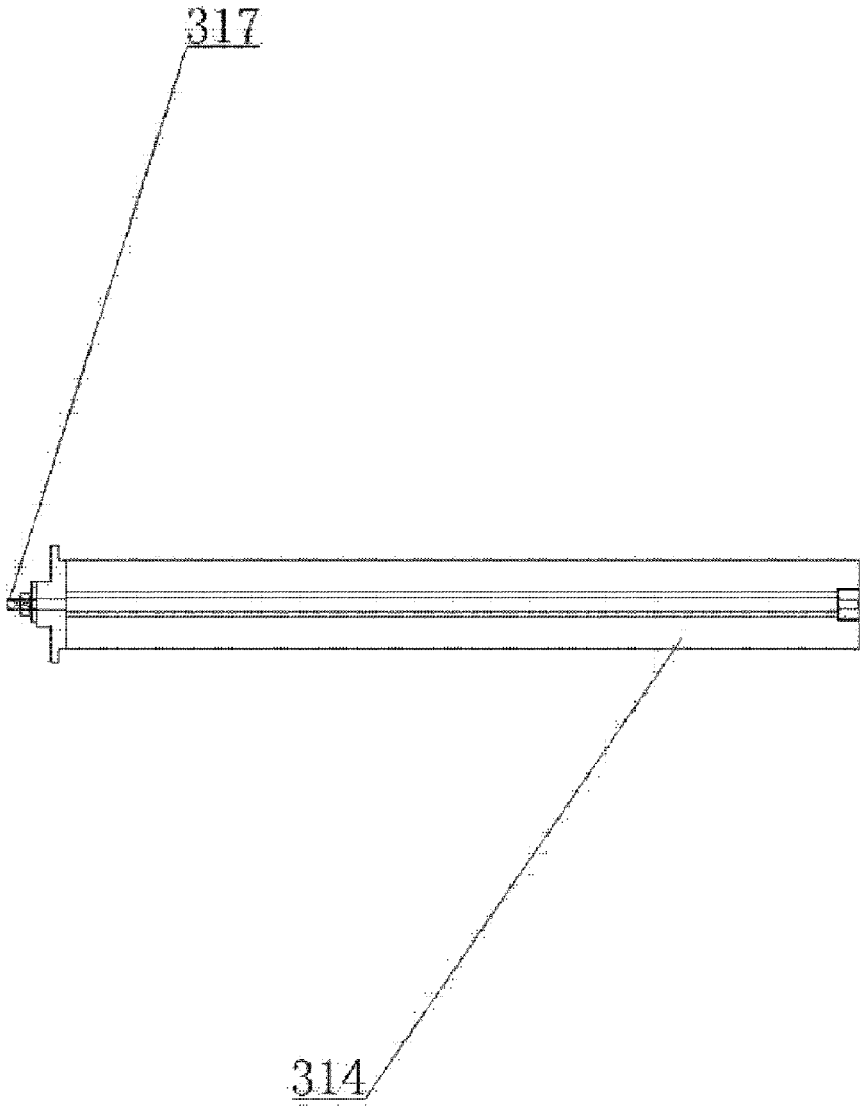
FIG. 5 is an isometric view of a wind board of the present invention.

Referring to FIGS. 1 and 5, the wind adjusting unit 313 includes the wind boards 314, the wind boards 314 are movably connected with two opposite sidewalls of the furnace box 10 through hinges 317, the wind boards 314 can be multiple, and axes of the hinges 317 of the wind boards 314 are parallel to each other, and located on the same plane, the plane is parallel to the bottom of the furnace box 10.

Each heating unit 311 includes electric heating pipes 312 located on/below the wind board 314, the electric heating pipes 312 are multiple, and the electric heating pipes 312 are all parallel to the bottom of the furnace box 10. Each electric heating pipe 312 has a bottom layer and a top layer, the bottom layer and the top layer are both parallel to the bottom of the furnace box 10 and located at the bottom of the furnace box 10.

Figure 2:
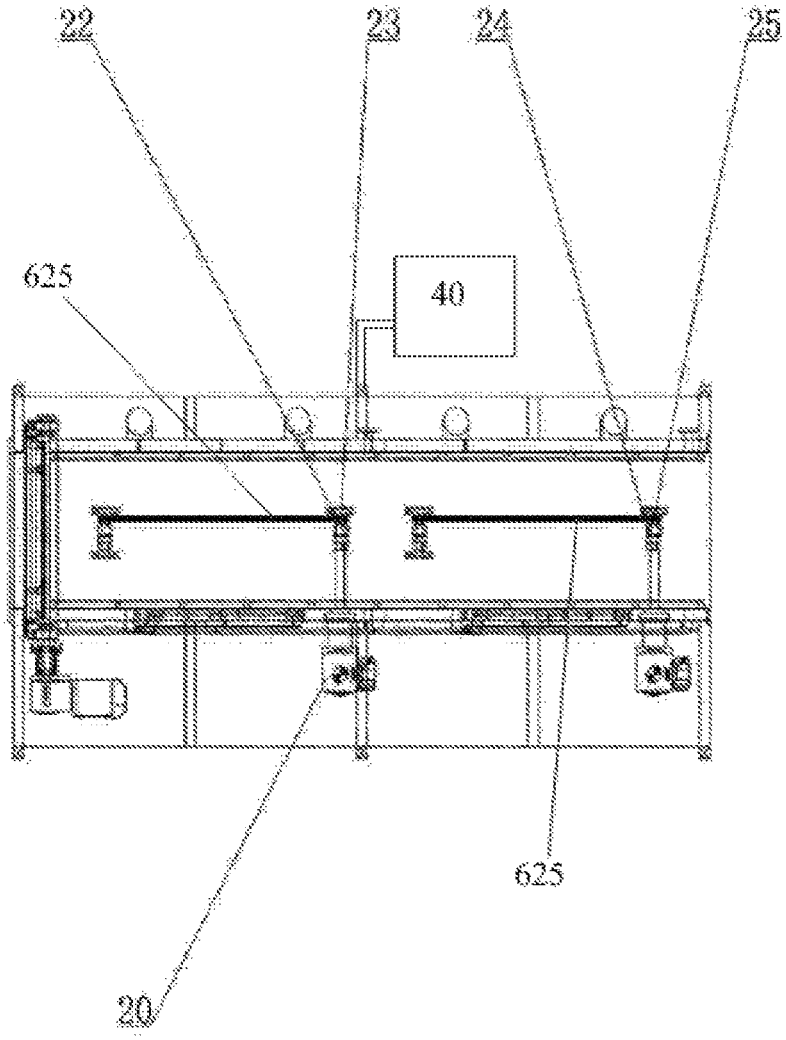
FIG. 2 is an isometric view of a transporting device of the present invention.

Referring to FIG. 2, the transporting device 20 includes first gears 22 which are driven by a motor. The first gears 22 are coaxial with first chain wheels 23 and fixed with the first chain wheels 23, the transporting device 20 further includes second gears 24 located in the furnace box 10, the second gears 24 are coaxial with second chain wheels 25 and fixed with the second chain wheels 25, the second chain wheels 25 are driven by the first chain wheels 23 through a chain 625.

It must be pointed out that, the example embodiments have been described hereinabove, however the invention is not limited to the above example embodiments. Various modifications to and departures from the disclosed example embodiments will occur to those having ordinary skill in the art. The subject matter that is intended to be within the spirit of this disclosure is set forth in the following claims.

The invention claimed is:

1. An automatic vacuum preheating furnace, comprising a furnace box (10), a vacuum extraction device used to evacuate the furnace box (10), a transporting device (20) located inside the furnace box (10) and used to transport materials, two opposite ends of the furnace box (10) having an opening (11) respectively, an automatic sealing door (12) being located at each of the openings (11), wherein the automatic vacuum preheating furnace further includes preheating devices (30), each preheating device (30) includes a blasting device (310) which is located under the furnace box (10) and connected with the furnace box (10), and a wind returning device (320) which is located above the furnace box (10) and connected with the furnace box (10), each blasting device (310) includes a heating unit (311) and a wind adjusting unit (313), wherein each wind adjusting unit (313) includes wind boards (314), the wind boards (314) are movably connected with two opposite sidewalls of the furnace box (10) through hinges (317), the wind boards (314) are multiple, and axes of the hinges (317) of the wind boards (314) are parallel to each other, and located on a same plane, the plane is parallel to a bottom of the furnace box (10).

2. The automatic vacuum preheating furnace as set forth in claim 1, wherein each heating unit 311 includes electric heating pipes (312) located on/below the wind board (314), and the electric heating pipes (312) are all parallel to the bottom of the furnace box (10).

3. The automatic vacuum preheating furnace as set forth in claim 2, wherein each electric heating pipe (312) has a bottom layer and a top layer, the bottom layer and the top layer are both parallel to the bottom of the furnace box (10) and located at the bottom of the furnace box (10).

4. The automatic vacuum preheating furnace as set forth in claim 1, wherein each blasting device (310) is connected with the furnace box (10) through a wind inlet (315), a portion of the bottom of the furnace box (10) corresponding to the wind inlet (315) has a plurality of through openings (11).

5. The automatic vacuum preheating furnace as set forth in claim 1, wherein an exit of the wind returning device (320) is connected with an entrance of the blasting device (310).

6. The automatic vacuum preheating furnace as set forth in claim 1, wherein the automatic vacuum preheating furnace has multiple sets of the preheating devices (30), and the preheating devices (30) are located along a transporting direction of the transporting device (20).

7. The automatic vacuum preheating furnace as set forth in claim 1, wherein the automatic vacuum preheating furnace further includes a plurality of wind guide separators (316) located below the wind boards (314), the wind boards (314) are located above portions between two adjacent wind guide separators (316).

8. The automatic vacuum preheating furnace as set forth in claim 1, wherein the transporting device (20) includes a plurality of first gears (22) located in the furnace box (10), the first gears (22) are driven by a motor.

9. The automatic vacuum preheating furnace as set forth in claim 8, wherein the first gears (22) are coaxial with first chain wheels (23) and fixed with the chain wheels (23), the transporting device (20) further includes a plurality of second gears (24) located in the furnace box (10), the second gears (24) are coaxial with second chain wheels (25) and fixed with the second chain wheels (25), the second chain wheels (25) are driven by the chain wheels (23) through a motor.

10. An automatic vacuum preheating furnace, comprising a furnace box (10), a vacuum extraction device used to evacuate the furnace box (10), a transporting device (20) located inside the furnace box (10) and used to transport materials, two opposite ends of the furnace box (10) having an opening (11) respectively, an automatic sealing door (12) being located at each of the opening (11), wherein the automatic vacuum preheating furnace further includes preheating devices (30), each preheating device (30) includes a blasting device (310) which is located under the furnace box (10) and connected with the furnace box (10), and a wind returning device (320) which is located above the furnace box (10) and connected with the furnace box (10), each blasting device (310) includes a heating unit (311) and a wind adjusting unit (313), wherein the automatic vacuum preheating furnace further includes a plurality of wind guide separators (316) located below the wind boards (314), the wind boards (314) are located above portions between two adjacent wind guide separators (316).

* * * * *